US011506402B2

(12) United States Patent
Matsui et al.

(10) Patent No.: US 11,506,402 B2
(45) Date of Patent: Nov. 22, 2022

(54) OUTDOOR UNIT OF AIR-CONDITIONING APPARATUS AND AIR-CONDITIONING APPARATUS

(71) Applicant: Mitsubishi Electric Corporation, Tokyo (JP)

(72) Inventors: Shigeyoshi Matsui, Tokyo (JP); Takashi Matsumoto, Tokyo (JP); Yoji Onaka, Tokyo (JP); Rihito Adachi, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 70 days.

(21) Appl. No.: 15/733,900

(22) PCT Filed: Jun. 11, 2018

(86) PCT No.: PCT/JP2018/022147
§ 371 (c)(1),
(2) Date: Dec. 1, 2020

(87) PCT Pub. No.: WO2019/239446
PCT Pub. Date: Dec. 19, 2019

(65) Prior Publication Data

US 2021/0222893 A1 Jul. 22, 2021

(51) Int. Cl.
*F24H 3/00* (2022.01)
*F24F 1/18* (2011.01)

(52) U.S. Cl.
CPC ..... *F24F 1/18* (2013.01)

(58) Field of Classification Search
CPC .. F28D 1/05391; F28D 1/0435; F28D 1/0552; F28D 1/0443; F28D 1/0452;
(Continued)

(56) References Cited

U.S. PATENT DOCUMENTS 5,622,219 A 4/1997 Voss et al.
5,685,366 A 11/1997 Voss et al.
(Continued)

FOREIGN PATENT DOCUMENTS

CN 104969022 A 10/2015
CN 106233077 A 12/2016
(Continued)

OTHER PUBLICATIONS

Pdf file is translation of foreign reference WO2016158193A1 (Year: 2016).*
(Continued)

*Primary Examiner* — Henry T Crenshaw
*Assistant Examiner* — Kamran Tavakoldavani
(74) *Attorney, Agent, or Firm* — Xsensus LLP

(57) ABSTRACT

An outdoor unit of an air-conditioning apparatus includes a heat exchange body including a plurality of flat tubes that extend in a vertical direction and that are arranged in a horizontal direction with gaps therebetween. A plurality of the heat exchange bodies are arranged in a direction of air flow to form a heat exchanger. A first header, into which hot gas refrigerant flows from a refrigerant circuit, is provided below one of the plurality of the heat exchange bodies that is at a most upwind position.

15 Claims, 9 Drawing Sheets

(58) Field of Classification Search
CPC ..... F28D 2021/0068; F24F 1/16; F24F 1/18; F24F 1/50; F24F 11/42; F28F 9/0209; F28F 9/26; F28F 9/02; F28F 2009/004
See application file for complete search history.

(56) References Cited

U.S. PATENT DOCUMENTS

| | | | | |
|---|---|---|---|---|
| 5,901,782 | A | 5/1999 | Voss et al. | |
| 10,544,969 | B2 * | 1/2020 | Jindou | F28D 1/053 |
| 2014/0124183 | A1 | 5/2014 | Hwang et al. | |
| 2015/0059400 | A1 | 3/2015 | Okazaki et al. | |
| 2017/0122630 | A1 | 5/2017 | Okazaki | |
| 2018/0100659 | A1 | 4/2018 | Yoshimura et al. | |
| 2018/0135900 | A1 | 5/2018 | Jindou et al. | |

FOREIGN PATENT DOCUMENTS

| | | | | |
|---|---|---|---|---|
| CN | 107407534 | A | | 11/2017 |
| EP | 3156752 | A1 | | 4/2017 |
| JP | 8-178445 | A | | 7/1996 |
| JP | 8-261687 | A | | 10/1996 |
| JP | 2002-243209 | A | | 8/2002 |
| JP | 2005-133966 | A | | 5/2005 |
| JP | 2009-257741 | A | | 11/2009 |
| JP | 2013-139971 | A | | 7/2013 |
| JP | 2015055415 | A | * | 3/2015 |
| JP | 2015-203506 | A | | 11/2015 |
| JP | 2017-180888 | A | | 10/2017 |
| WO | 2013/160957 | A1 | | 10/2013 |
| WO | 2015/162689 | A1 | | 10/2015 |
| WO | 2015/189990 | A1 | | 12/2015 |
| WO | 2016/158193 | A1 | | 10/2016 |
| WO | WO-2016158193 | A1 | * | 10/2016 ..... F24F 1/18 |
| WO | 2016/174830 | A1 | | 11/2016 |

OTHER PUBLICATIONS

Pdf is translation of foreign reference JP2015055415A (Year: 2015).*
Attached pdf is translation of foreign reference WO 2016158193 A1 (Year: 2016).*
Attached pdf is translation of foreign reference JP 2015055415 A (Year: 2015).*
Office Action dated Dec. 13, 2021, in corresponding Chinese patent Application No. 201880093772.0, 16 pages.
Chinese Office Action dated Jun. 24, 2021, in corresponding Chinese Patent Application No. 201880093772.
Extended European search report dated May 17, 2021, in corresponding European patent Application No. 18922685.5, 8 pages.
Office Action dated Jun. 11, 2019 in Japanese Patent Application No. 2018-556000, 6 pages.
International Search Report and Written Opinion dated Aug. 21, 2018, received for PCT Application No. PCT/JP2018/022147, filed on Jun. 11, 2018, 10 pages including English Translation.
Notice of Reasons for Refusal received for Japanese Patent Application No. 2018-556000, dated Jan. 8, 2019, 3 pages including English Translation.
Notice of Reasons for Refusal received for Japanese Patent Application No. 2018-556000, dated Jun. 11, 2019, 6 pages including English Translation.

* cited by examiner

OUTDOOR UNIT OF AIR-CONDITIONING APPARATUS AND AIR-CONDITIONING APPARATUS

CROSS-REFERENCE TO RELATED APPLICATION

The present application is based on PCT filing PCT/JP2018/022147, filed Jun. 11, 2018, the entire contents of which are incorporated herein by reference.

TECHNICAL FIELD

The present disclosure relates to an outdoor unit of an air-conditioning apparatus and an air-conditioning apparatus, the outdoor unit including a heat exchanger having a plurality of heat exchange bodies, each of which includes a plurality of flat tubes.

BACKGROUND ART

A heat exchanger including, as heat transfer tubes, flat tubes, which are smaller in diameter as compared with circular tubes, distributes refrigerant between a greater number of paths than when circular tubes are used. To ensure efficient performance of the heat exchanger, two-phase gas-liquid refrigerant that flows through a collecting pipe, such as a header, needs to be appropriately distributed between the flat tubes depending on the amount of heat exchanged by the heat exchanger.

An example of a known heat exchanger including flat tubes includes heat exchange bodies which each include a plurality of fins and a plurality of flat tubes and which are combined together and formed in a rectangular shape to reduce the number of paths between which refrigerant is distributed (see, for example, Patent Literature 1). The fins are arranged with gaps therebetween to allow air to flow through the gaps. The flat tubes are inserted into a collecting pipe so that the refrigerant flows through the collecting pipe in a direction in which the fins are arranged.

CITATION LIST

Patent Literature

Patent Literature 1: International Publication No. 2016/174830

SUMMARY OF INVENTION

Technical Problem

When the heat exchanger incorporating the technology of Patent Literature 1 is used in a low-temperature environment in which frost accumulates on the heat exchanger, water generated when the flat tubes are defrosted flows downward along the plate fins and is discharged. The heat exchanger performs a defrosting operation by causing hot gas refrigerant to flow through a main heat exchange region, which is positioned in an upper region, and then through an auxiliary heat exchange region, which is positioned in a lower region. Therefore, it takes a long time to melt the frost formed on the plate fins in the lower region, which is a downstream region of a discharge path for the water generated when the flat tubes are defrosted, and the water cannot be smoothly discharged. Accordingly, the defrosting operation takes a long time or solid ice is formed on a lower portion of the heat exchanger, which degrades the defrosting performance.

A top-flow outdoor unit of an air-conditioning apparatus includes a fan disposed in an upper region, and has a large wind speed variation in the height direction. Even when refrigerant is evenly distributed between the flat tubes, the wind speed is high in an upper region close to the fan and varies in the up-down direction. This causes an uneven thermal load on the flat tubes arranged in parallel to each other in the up-down direction, and the heat exchange performance is degraded.

The present disclosure has been made to solve the above-described problems, and an object thereof is to provide an outdoor unit of an air-conditioning apparatus and an air-conditioning apparatus in which a lower portion of a heat exchanger is preferentially defrosted and water discharge is facilitated so that the defrosting performance is improved, and in which differences in the amount of heat exchange between flat tubes are reduced so that the heat exchange performance is improved.

Solution to Problem

An outdoor unit of an air-conditioning apparatus according to an embodiment of the present disclosure includes a heat exchange body including a plurality of flat tubes that extend in a vertical direction and that are arranged in a horizontal direction with gaps therebetween. A plurality of the heat exchange bodies are arranged in a direction of air flow to form a heat exchanger. A first header, into which hot gas refrigerant flows from a refrigerant circuit, is provided below one of the plurality of the heat exchange bodies that is at a most upwind position.

An air-conditioning apparatus according to another embodiment of the present disclosure includes the above-described outdoor unit of an air-conditioning apparatus.

Advantageous Effects of Invention

According to the outdoor unit of an air-conditioning apparatus and the air-conditioning apparatus of the embodiments of the present disclosure, the outdoor unit includes the heat exchange bodies which each include the flat tubes that extend in the vertical direction and that are arranged in the horizontal direction with gaps therebetween. The first header, into which hot gas refrigerant flows from the refrigerant circuit, is provided below one of the heat exchange bodies that is at the most upwind position. Accordingly, the hot gas refrigerant flows into the heat exchange body at the most upwind position from the bottom through the first header, so that a lower portion of the heat exchanger is preferentially defrosted and water discharge is facilitated. In addition, the flat tubes extend in the vertical direction and are arranged in the horizontal direction with gaps therebetween. Accordingly, the flat tubes arranged in parallel to each other in the horizontal direction receive the same thermal load in a region where the wind speed varies in the up-down direction. Thus, the lower portion of the heat exchanger is preferentially defrosted and water discharge is facilitated so that the defrosting performance can be improved, and differences in the amount of heat exchange between the flat tubes are reduced so that the heat exchange performance can be improved.

DESCRIPTION OF EMBODIMENTS

Figure 1:
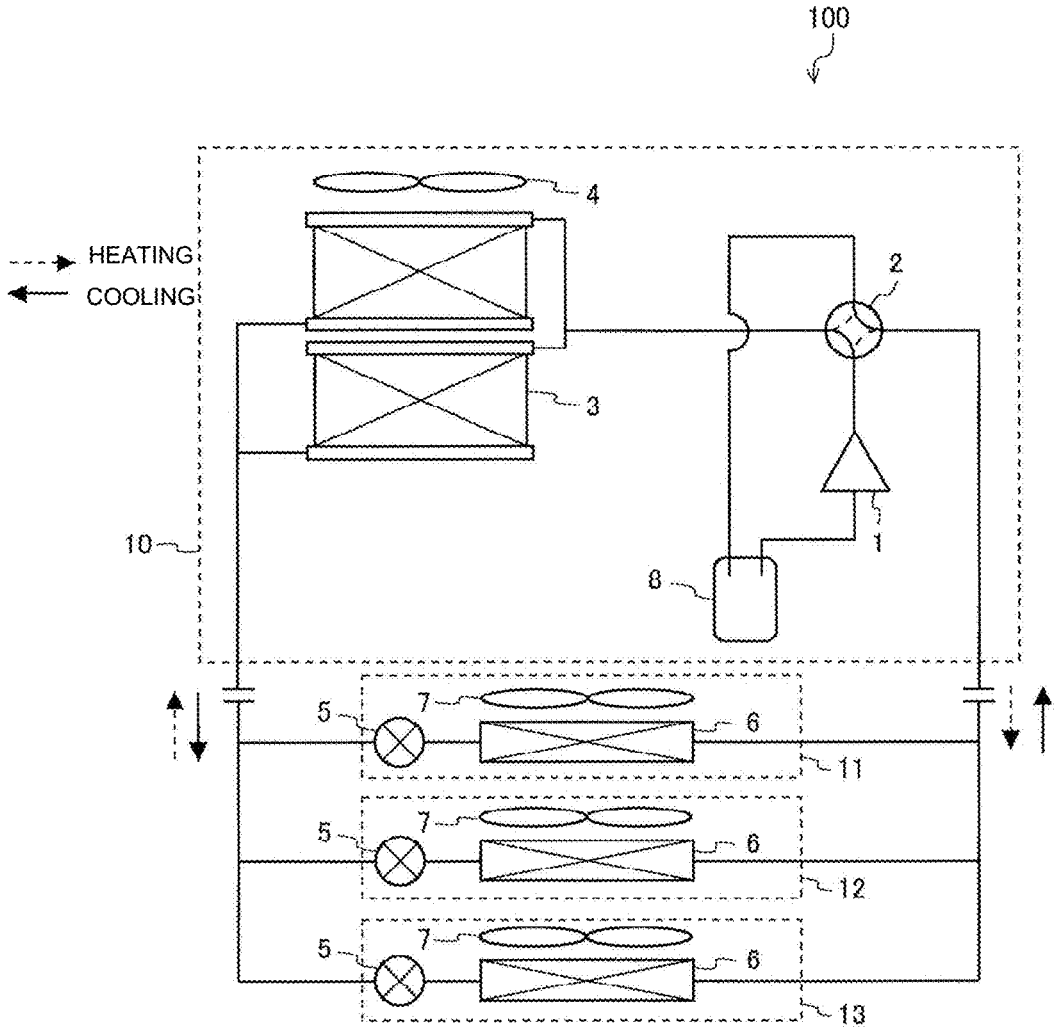
FIG. 1 is a refrigerant circuit diagram of an air-conditioning apparatus according to Embodiment 1 of the present disclosure.

Embodiments of the present disclosure will now be described with reference to the drawings. In the drawings, components denoted by the same reference signs are the same or corresponding components. This applies throughout the specification. In sectional views, cross-hatching is omitted as appropriate for clarity. Forms of components described in the specification are merely examples, and are not restrictive.

Embodiment 1

<Structure of Air-Conditioning Apparatus 100>

FIG. 1 is a refrigerant circuit diagram of an air-conditioning apparatus 100 according to Embodiment 1 of the present disclosure. As illustrated in FIG. 1, the air-conditioning apparatus 100 includes an outdoor unit 10 and a plurality of indoor units 11, 12, and 13. The outdoor unit 10 is connected to the indoor units 11, 12, and 13, and refrigerant circulates through the outdoor unit 10 and the indoor units 11, 12, and 13. The air-conditioning apparatus 100 is a multiple-split air-conditioning apparatus. In Embodiment 1, three indoor units 11, 12, and 13 are connected to the outdoor unit 10. However, the number of indoor units connected to the outdoor unit 10 of the present disclosure is not limited.

The air-conditioning apparatus 100 includes a refrigerant circuit formed by connecting a compressor 1, a four-way valve 2, an outdoor heat exchanger 3, expansion valves 5, indoor heat exchangers 6, and an accumulator 8 with refrigerant pipes. The outdoor heat exchanger 3 and the indoor heat exchangers 6 each causes heat to be exchanged between the refrigerant and air that flow therethrough due to wind generated by fans 4 and 7.

<Structure of Outdoor Unit 10 of Air-Conditioning Apparatus 100>

Figure 2:
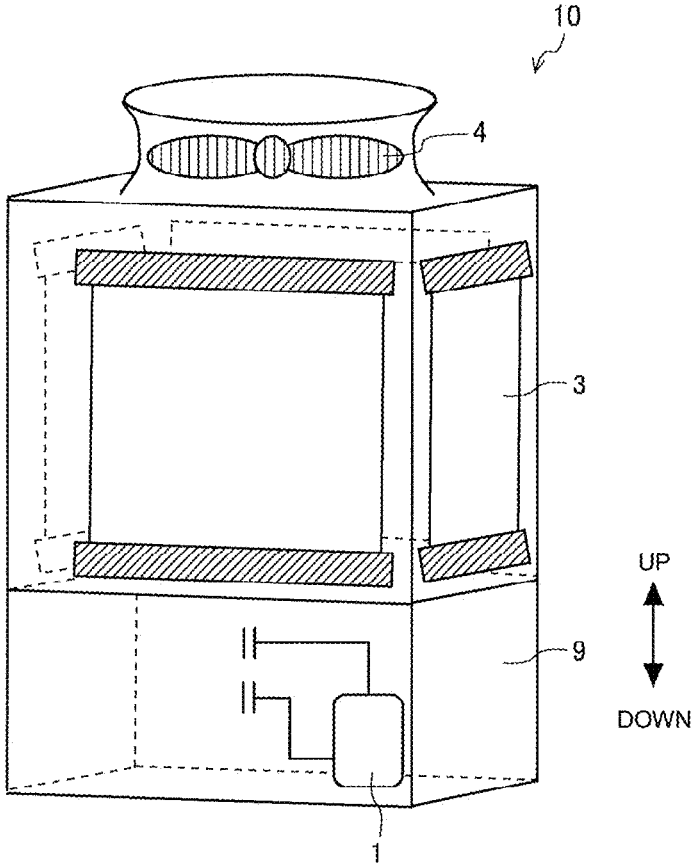
FIG. 2 is a perspective view of an outdoor unit of the air-conditioning apparatus according to Embodiment 1 of the present disclosure.

FIG. 2 is a perspective view of the outdoor unit 10 of the air-conditioning apparatus 100 according to Embodiment 1 of the present disclosure. As illustrated in FIG. 2, the outdoor unit 10 of the air-conditioning apparatus 100 includes the compressor 1, the fan 4, and the outdoor heat exchanger 3. The fan 4 is disposed above the outdoor heat exchanger 3, and blows air upward. Thus, the outdoor unit 10 of the air-conditioning apparatus 100 is a top-flow outdoor unit in which the fan 4 that blows air upward is disposed above the outdoor heat exchanger 3 including a plurality of heat exchange bodies 20. The outdoor heat exchanger 3 includes a plurality of side portions that surround a downward projection region of the fan 4. The outdoor heat exchanger 3 including the heat exchange bodies 20 is disposed in an upper section of the outdoor unit 10 of the air-conditioning apparatus 100 that is close to the fan 4. The compressor 1 is disposed in a lower section of a housing 9 of the outdoor unit 10. The bottom end of the outdoor heat exchanger 3 is positioned above the top end of the compressor 1. The outdoor heat exchanger 3 is disposed in an upper section of the housing 9 of the outdoor unit 10 that is adjacent to the fan 4 and in which the air suction efficiency of the fan 4 is high.

<Structure of Outdoor Heat Exchanger 3>

Figure 3:
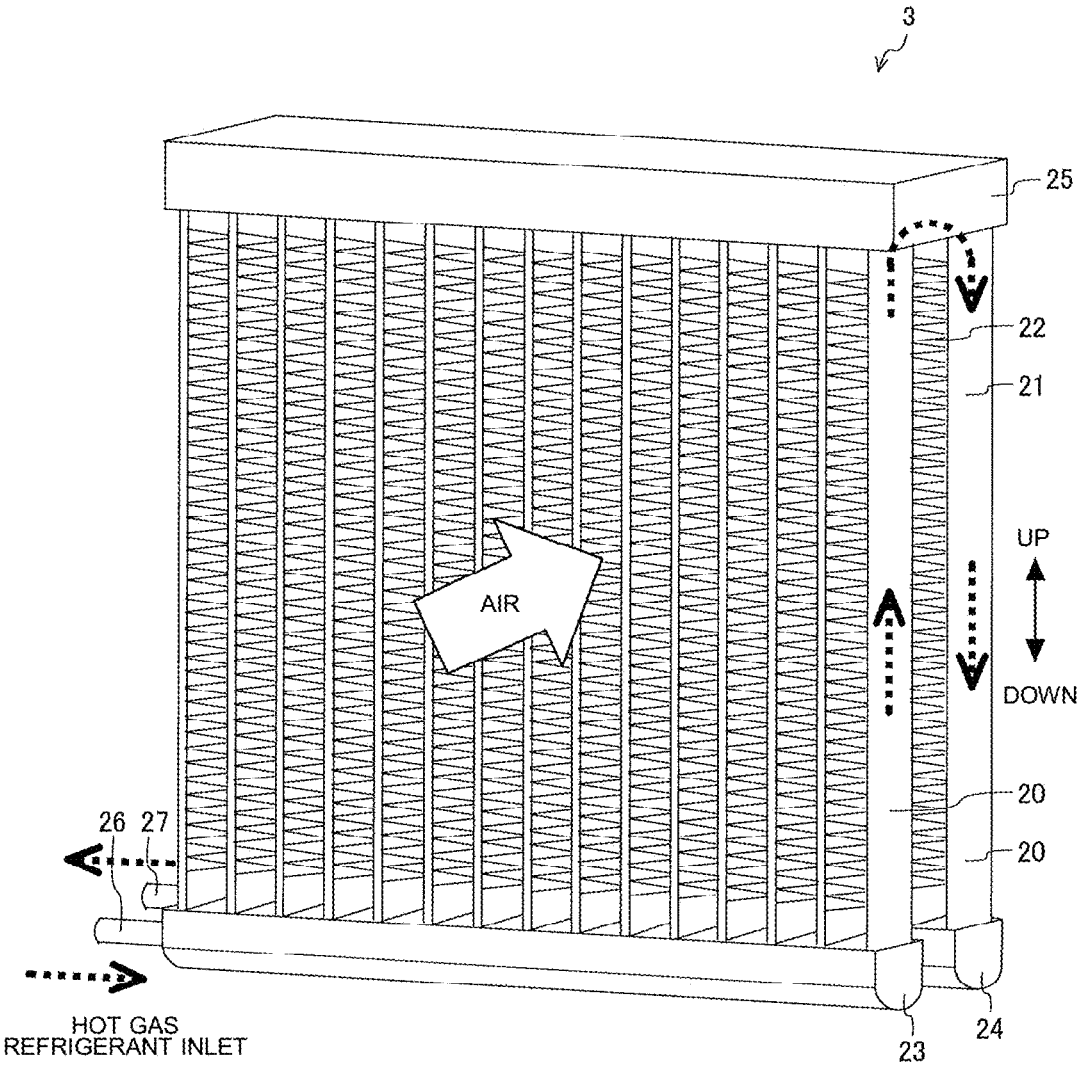
FIG. 3 is an enlarged perspective view of part of an outdoor heat exchanger according to Embodiment 1 of the present disclosure.

FIG. 3 is an enlarged perspective view of part of the outdoor heat exchanger 3 according to Embodiment 1 of the present disclosure. In FIG. 3, the white arrow shows the flow of wind generated by the fan 4. As illustrated in FIG. 3, the outdoor heat exchanger 3 includes the heat exchange bodies 20 arranged in the direction of air flow. Each of the heat exchange bodies 20 includes a plurality of flat tubes 21 extending in a vertical direction and arranged in a horizontal direction with gaps therebetween. Each of the heat exchange bodies 20 also includes fins 22 joined to the flat tubes 21. In FIG. 3, two heat exchange bodies 20 having the same size are arranged in the direction of air flow.

The flat tubes 21 are arranged in parallel to each other in the horizontal direction with gaps therebetween to allow wind generated by the fan 4 to flow through the gaps. The refrigerant flows in the up-down direction through the tubes that extend in the up-down direction. The fins 22 extend between and are connected to the flat tubes 21 that are adjacent to each other, and transfer heat to the flat tubes 21. The fins 22 are provided to increase the heat exchange efficiency between air and the refrigerant, and are composed of, for example, corrugated fins. However, the fins 22 are not limited to this. The fins 22 may be omitted because heat exchange between air and the refrigerant occurs on the surfaces of the flat tubes 21.

A first header 23 is provided below one of the heat exchange bodies 20 that is at the most upwind position. The bottom ends of the flat tubes 21 included in the heat exchange body 20 at the most upwind position are directly inserted into the first header 23. The first header 23 is connected to the refrigerant circuit of the air-conditioning apparatus 100 by a refrigerant pipe 26, and hot gas refrigerant flows into the first header 23 from the refrigerant circuit. The first header 23 is referred to also as a gas header. The first header 23 causes high-temperature high-pressure gas refrigerant from the compressor 1 to flow into the outdoor heat exchanger 3 in a cooling operation, and causes gas refrigerant to flow out into the refrigerant circuit after exchanging heat in the outdoor heat exchanger 3 in a heating operation.

A refrigerant distributor 24 is provided below one of the heat exchange bodies 20 that is at the most downwind position. The refrigerant distributor 24 is disposed in parallel to the first header 23. The refrigerant distributor 24 is connected to the refrigerant circuit of the air-conditioning apparatus 100 by a refrigerant pipe 27.

A turnaround header 25 is provided above the heat exchange bodies 20, and the top ends of the flat tubes 21 inserted into the first header 23 and the refrigerant distributor 24 are inserted into the turnaround header 25.

The flat tubes 21, the fins 22, the first header 23, the refrigerant distributor 24, the turnaround header 25, and the refrigerant pipes 26 and 27 are all made of aluminum, and are joined together by brazing.

<Refrigerant Distributor 24>

Figure 4:
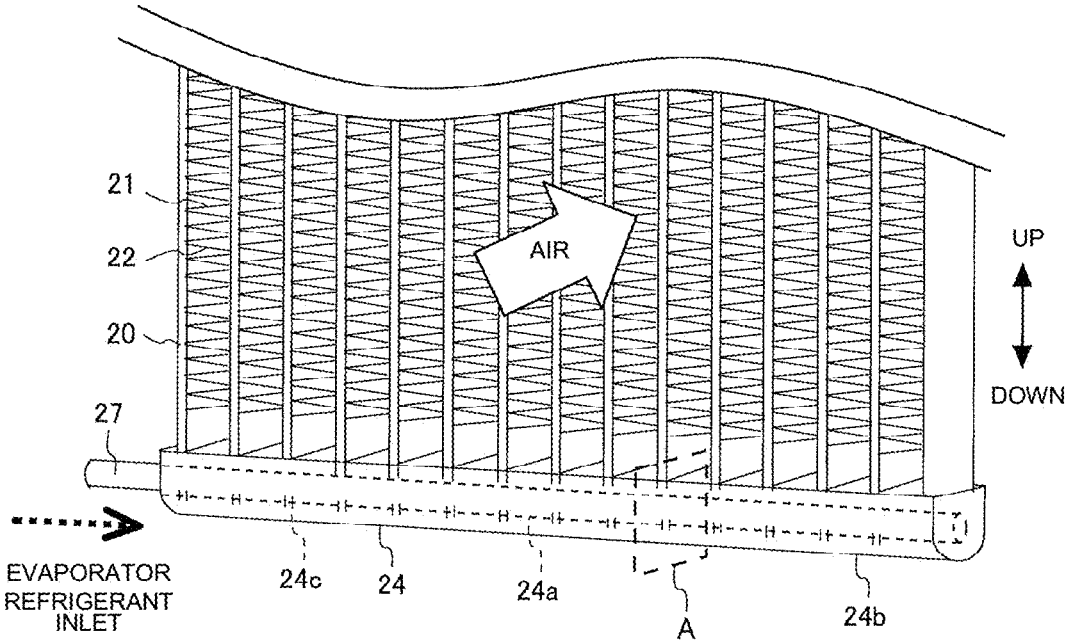
FIG. 4 is a diagram illustrating a refrigerant distributor according to Embodiment 1 of the present disclosure.
Figure 5:
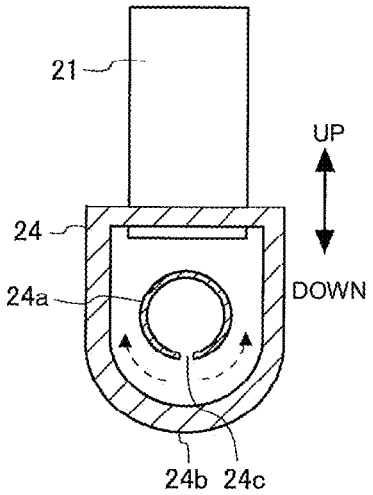
FIG. 5 is a sectional view of part A of the refrigerant distributor according to Embodiment 1 of the present disclosure illustrated in FIG. 4.

FIG. 4 is a diagram illustrating the refrigerant distributor 24 according to Embodiment 1 of the present disclosure. FIG. 5 is a sectional view of part A of the refrigerant distributor 24 according to Embodiment 1 of the present disclosure illustrated in FIG. 4. As illustrated in FIGS. 4 and 5, the refrigerant distributor 24 is disposed below one of the heat exchange bodies 20 at the most downwind position. The refrigerant distributor 24 has a double-pipe structure including an inner pipe 24*a* and an outer pipe 24*b*.

The inner pipe 24*a* is a circular pipe. The inner pipe 24*a* has a plurality of refrigerant holes 24*c* that are arranged with gaps therebetween and through which the refrigerant flows. All of the refrigerant holes 24*c* open downward in a lower portion of the inner pipe 24*a*. The inner pipe 24*a* is inserted in the outer pipe 24*b*. When the outdoor heat exchanger 3 functions as an evaporator, the refrigerant from the refrigerant circuit flows into the inner pipe 24*a* through the refrigerant pipe 27.

The outer pipe 24*b* has a U-shaped cross section with an arc portion at the bottom. The outer pipe 24*b* having the U-shaped cross section smoothly changes the flow of refrigerant from the refrigerant holes 24*c*, which open downward, into an upward flow along the arc portion. The inner pipe 24*a* and the outer pipe 24*b* extend straight in a pipe extending direction. The inner pipe 24*a* and the outer pipe 24*b* are joined together by brazing.

The outdoor heat exchanger 3 has a refrigerant flow passage along which, when the outdoor heat exchanger 3 functions as an evaporator, the refrigerant flows into one of the heat exchange bodies 20 at the most downwind position through the refrigerant distributor 24 and flows out of one of the heat exchange bodies 20 at the most upwind position so that the refrigerant and air flow in opposite directions.

<Operation of Refrigerant Circuit>

In a heating operation, the refrigerant is compressed by the compressor into high-temperature high-pressure gas refrigerant, and flows into the indoor heat exchangers 6 through the four-way valve 2. The refrigerant that has flowed into the indoor heat exchangers 6 dissipate heat due to wind generated by the fans 7, and is thereby condensed and liquefied. The liquefied refrigerant is decompressed by the expansion valves 5 into low-temperature low-pressure refrigerant in a two-phase gas-liquid state, and flows into the outdoor heat exchanger 3 through the refrigerant distributor 24. The refrigerant that has flowed into the outdoor heat exchanger 3 causes heat exchange to be performed with air on the wind generated by the fan 4, and is thereby evaporated and gasified. The gasified refrigerant flows out through the first header 23. The refrigerant that has flowed out through the first header 23 passes through the accumulator 8 and is sucked into the compressor 1 again. Thus, the refrigerant circulates through the refrigerant circuit. In addition to the refrigerant, refrigerating machine oil required to drive the compressor 1 also circulates through the refrigerant circuit. In a cooling operation, the refrigerant and the refrigerating machine oil flow through the refrigerant circuit in the opposite direction.

<Operation of Outdoor Heat Exchanger 3>

In the heating operation, the outdoor heat exchanger 3 functions as an evaporator. The two-phase gas-liquid refrigerant that enters the outdoor heat exchanger 3 from the refrigerant circuit flows into the inner pipe 24*a*, which is inserted into the outer pipe 24*b*. The refrigerant that has flowed into the inner pipe 24*a* is discharged from the refrigerant holes 24*c*, and is distributed between the flat tubes 21. The refrigerant that flows through the flat tubes 21 exchanges heat with air carried by the wind generated by the fan 4, and is thereby evaporated. The wind generated by the fan 4 flows through the outdoor heat exchanger 3 disposed so as to surround the fan 4 and then flows upward. The refrigerant evaporated in the flat tubes 21 flows into and is collected in the first header 23, and flows out of the outdoor heat exchanger 3 through the refrigerant pipe 26. The refrigerant that flows through the outdoor heat exchanger 3 flows through the flat tubes 21 of the heat exchange body 20 at the downwind position first, and then flows through the flat tubes 21 of the heat exchange body 20 at the upwind position. Thus, air and the refrigerant flow in opposite directions. In a cooling operation, in which the outdoor heat exchanger 3 functions as a condenser, the refrigerant flows in a direction opposite to the direction in which the refrigerant flows when the outdoor heat exchanger 3 functions as an evaporator as described above.

<Defrosting Operation>

When the heating operation is performed in a low-temperature environment in which the surface temperatures of the flat tubes 21 and the fins 22 are less than or equal to 0 degrees C., frost accumulates on the outdoor heat exchanger 3. When the amount of frost on the outdoor heat exchanger 3 reaches or exceeds a certain amount, wind passages in the outdoor heat exchanger 3 for the wind generated by the fan 4 are blocked and the performance of the outdoor heat exchanger 3 is degraded. Accordingly, the heating performance is degraded. When the heating performance is degraded, a defrosting operation is performed to melt the frost on the surface of the outdoor heat exchanger 3.

In the defrosting operation, the fan 4 is stopped and the refrigerant circuit is set to the cooling operation, for example, so that hot gas refrigerant at a high temperature flows into the outdoor heat exchanger 3. Thus, the frost on the flat tubes 21 and the fins 22 is melted. In the defrosting operation, the hot gas refrigerant at a high temperature that has flowed into the outdoor heat exchanger 3 flows through the first header 23 disposed below the heat exchange body 20 at the most upwind position and enters each of the flat tubes 21. The high-temperature refrigerant that has entered the flat tubes 21 melts the frost on the flat tubes 21 and the fins 22 into water from the bottom. The water generated when the frost is melted is discharged toward the bottom of the outdoor heat exchanger 3 along the flat tubes 21 and the fins 22. When the accumulated frost is melted, the defrosting operation is ended and the heating operation is restarted.

<Operation of Embodiment 1>

As illustrated in FIG. 2, the outdoor unit 10 includes the fan 4 that is disposed above the outdoor heat exchanger 3 and blows wind upward. The outdoor heat exchanger 3 is disposed to surround the fan 4 or the downward projection region of the fan 4. Therefore, the wind that flows through the outdoor heat exchanger 3 has a wind speed variation in the up-down direction. More specifically, the wind easily flows at a high speed through an upper portion of the outdoor heat exchanger 3 that is close to the fan 4. The wind speed decreases toward a lower portion of the outdoor heat exchanger 3 that is distant from the fan 4. The heat exchange efficiency is high in a region where the wind speed is high. The outdoor heat exchanger 3 includes the flat tubes 21 extending in the vertical direction and arranged in a horizontal direction so that the refrigerant flows in the up-down direction through the region having the wind speed variation in the up-down direction. Therefore, the flat tubes 21 have the same heat exchange efficiency. Accordingly, the heat exchange performance can be improved by evenly distributing the refrigerant between the flat tubes 21. In addition, since the outdoor heat exchanger 3 is disposed in an upper section of the housing 9 of the outdoor unit 10 in which the air suction efficiency of the fan 4 is high, the performance of the outdoor heat exchanger 3 is further improved. In contrast, when the flat tubes are arranged such that the refrigerant flows therethrough in a horizontal direction, the heat exchange efficiency and the amount of heat exchange increase toward an upper portion of the outdoor heat exchanger that is close to the fan. Therefore, even when the refrigerant is evenly distributed between the heat transfer tubes, the heat exchange performance is degraded. Since the outdoor heat exchanger 3 is disposed in the upper section of the housing 9, a maintenance space for components disposed in a lower section of the housing 9, such as the compressor 1, can be provided. To be more specific, the compressor 1 is preferably disposed in, for example, a bottom section of the housing 9 of the outdoor unit 10, and the bottom end of the outdoor heat exchanger 3 at one side thereof is positioned above the topmost end of the compressor 1. In such a case, maintenance, such as replacement, of the compressor 1 can be easily performed without changing the state of the outdoor heat exchanger 3. More preferably, to facilitate access to the compressor 1, the housing 9 may be structured such that a plate on a side thereof or only a lower portion of a side thereof can be removed.

As illustrated in FIGS. 4 and 5, in the heating operation, in which the outdoor heat exchanger 3 functions as an evaporator, two-phase gas-liquid refrigerant flows into the outdoor heat exchanger 3 through the inner pipe 24*a* inserted into the outer pipe 24*b* of the refrigerant distributor 24. The two-phase gas-liquid refrigerant passes through the refrigerant holes 24*c* formed in the inner pipe 24*a*, is stirred in the space defined between the inner pipe 24*a* and the outer pipe 24*b*, and flows in a state close to that of homogeneous flow. The refrigerant that flows in a homogenized state enters the flat tubes 21, so that the refrigerant is evenly distributed between the flat tubes 21 and the performance of the outdoor heat exchanger 3 can be improved. FIG. 4 shows a structure in which the refrigerant holes 24*c* open vertically downward. However, the direction in which the refrigerant holes 24*c* open in the inner pipe 24*a* may be changed.

When frost is formed on the outdoor heat exchanger 3 and the defrosting operation is performed, the refrigerant flows through the outdoor heat exchanger 3 in the same direction as the direction in which the refrigerant flows in the cooling operation. Accordingly, as illustrated in FIG. 3, hot gas refrigerant at a high temperature flows through the first header 23 disposed below the heat exchange body 20 at the most upwind position, and enters the flat tubes 21. The high-temperature refrigerant that has entered the flat tubes 21 melts the frost on the flat tubes 21 and the fins 22 preferentially from the bottom. Therefore, water generated when the frost is melted is smoothly discharged toward the bottom of the outdoor heat exchanger 3 along the flat tubes 21 and the fins 22, and the amount of water that remains on the surface of the outdoor heat exchanger 3 at the time when the accumulated frost is completely melted and when the defrosting operation is ended can be reduced. This effect does not depend on the direction in which wind is blown, and a similar effect can be obtained in, for example, a side-flow outdoor unit (not shown) in which wind is blown sideways.

If, for example, the hot gas refrigerant flows into the outdoor heat exchanger 3 from the top, the frost on the lower portion of the outdoor heat exchanger 3 impedes water discharge. Accordingly, water is not completely discharged when the accumulated frost is completely melted, and remains on the surface of the outdoor heat exchanger 3 when the heating operation is restarted. After the heating operation is restarted, the remaining water is solidified into frost again. The frost blocks the wind passages in the outdoor heat exchanger 3, and the performance of the outdoor heat exchanger 3 is degraded. In addition, the amount of heat required in the next defrosting operation is increased, and the defrosting efficiency is reduced.

When the heat exchange bodies 20 are arranged in the direction of air flow as illustrated in FIG. 3, the heat exchange body 20 at the upwind position exchanges a greater amount of heat and causes a greater amount of frost to accumulate on the outdoor heat exchanger 3. Therefore, the defrosting efficiency can be increased by causing the hot gas refrigerant to flow preferentially through the heat exchange body 20 at the upwind position.

When the heating operation, in which the outdoor heat exchanger 3 functions as an evaporator, is performed in a low-temperature environment in which the surface temperatures of the flat tubes 21 and the fins 22 are less than or equal to 0 degrees C., frost accumulates on the outdoor heat exchanger 3. Two-phase gas-liquid refrigerant flows into the outdoor heat exchanger 3 and is evenly distributed between the flat tubes 21 by the refrigerant distributor 24 disposed below the heat exchange body 20 at the most downwind position. The thus distributed refrigerant is evaporated by heat exchange with air carried by the wind generated by the fan 4, and flows out through the first header 23 disposed below the heat exchange body 20 at the most upwind position. Therefore, gas refrigerant at a temperature higher than that of the two-phase gas-liquid refrigerant flows through the flat tubes 21 in a region close to the first header 23, which serves as the refrigerant outlet of the outdoor heat exchanger 3. Thus, solid ice is not easily formed on a lower portion of the heat exchange body 20 at the upwind position, on which a large amount of frost accumulates and water easily remains. This effect does not depend on the direction in which wind is blown, and a similar effect can be obtained in, for example, a side-flow outdoor unit (not shown) in which wind is blown sideways.

<Effects of Embodiment 1>

According to Embodiment 1, the outdoor unit 10 of the air-conditioning apparatus 100 includes the heat exchange bodies 20, each of which includes the flat tubes 21 extending in the vertical direction and arranged in a horizontal direction with gaps therebetween. The heat exchange bodies 20 are arranged in the direction of air flow to form the outdoor heat exchanger 3. The first header 23, into which hot gas refrigerant flows from the refrigerant circuit, is provided below one of the heat exchange bodies 20 that is at the most upwind position.

According to this structure, water generated when the flat tubes 21 are defrosted is discharged downward along the flat tubes 21 and the fins 22. The first header 23, into which hot gas refrigerant flows from the refrigerant circuit, is provided below one of the heat exchange bodies 20 that is at the most upwind position. Accordingly, in the defrosting operation, hot gas refrigerant flows into the flat tubes 21 of the heat exchange body 20 at the most upwind position, on which the largest amount of frost accumulates, from the bottom through the first header 23, so that the lower portion of the outdoor heat exchanger 3 is preferentially defrosted and that water easily flows downstream along the water discharge path. Thus, an appropriate water discharge path is provided and water discharge is facilitated. In addition, the flat tubes 21 extend in the vertical direction and are arranged in a horizontal direction with gaps therebetween. Accordingly, in the top-flow or side-flow outdoor unit 10 of the air-conditioning apparatus 100 in which the wind speed varies in the up-down direction, the flat tubes 21 arranged in parallel to each other in the horizontal direction receive the same thermal load. In addition, the refrigerant can be evenly distributed between the flat tubes 21. Also, since the flat tubes 21 extend in the vertical direction and are arranged in a horizontal direction with gaps therebetween, frost evenly accumulates on the flat tubes 21 in a low-temperature environment. Therefore, the time required to defrost is the same for each flat tube 21. Thus, the lower portion of the outdoor heat exchanger 3 is preferentially defrosted and water discharge is facilitated so that the defrosting performance can be improved, and differences in the amount of heat exchange between the flat tubes 21 are reduced so that the heat exchange performance can be improved.

According to Embodiment 1, the refrigerant distributor 24 is provided below one of the heat exchange bodies 20 that is at the most downwind position. The refrigerant distributor 24 has a double-pipe structure including the inner pipe 24*a* having the refrigerant holes 24*c*, which are arranged with gaps therebetween and through which the refrigerant flows, and the outer pipe 24*b* in which the inner pipe 24*a* is inserted. The outdoor heat exchanger 3 has a refrigerant flow passage along which, when the outdoor heat exchanger 3 functions as an evaporator, the refrigerant flows into one of the heat exchange bodies 20 at the most downwind position through the refrigerant distributor 24 and flows out of one of the heat exchange bodies 20 at the most upwind position so that the refrigerant and air flow in opposite directions.

According to the above-described structure, in the heating operation, in which the outdoor heat exchanger 3 functions as an evaporator, two-phase gas-liquid refrigerant flows into the outdoor heat exchanger 3 through the inner pipe 24*a* of the refrigerant distributor 24. The two-phase gas-liquid refrigerant passes through the refrigerant holes 24*c* formed in the inner pipe 24*a*, is stirred in the space defined between the inner pipe 24*a* and the outer pipe 24*b*, and flows in a state close to that of homogeneous flow. The refrigerant that flows in a homogenized state enters the flat tubes 21, so that the refrigerant is evenly distributed between the flat tubes 21 and the performance of the outdoor heat exchanger 3 can be improved.

According to Embodiment 1, the outdoor unit 10 of the air-conditioning apparatus 100 includes the fan 4 that blows air upward. The fan 4 is disposed above the outdoor heat exchanger 3. The outdoor heat exchanger 3 includes the side portions that surround the downward projection region of the fan 4.

According to the above-described structure, the wind that flows through the outdoor heat exchanger 3 has a wind speed variation in the up-down direction. More specifically, the wind easily flows at a high speed through an upper portion of the outdoor heat exchanger 3 that is close to the fan 4. The wind speed decreases toward a lower portion of the outdoor heat exchanger 3 that is distant from the fan 4. The heat exchange efficiency is high in a region where the wind speed is high. The outdoor heat exchanger 3 includes the flat tubes 21 arranged in a horizontal direction so that the refrigerant flows in the up-down direction through the region having the wind speed variation in the up-down direction. Thus, the flat tubes 21 have the same heat exchange efficiency. Accordingly, the refrigerant is evenly distributed between the flat tubes 21, and the heat exchange performance is improved.

According to Embodiment 1, the outdoor heat exchanger 3 is disposed in an upper section of the housing 9 that is adjacent to the fan 4.

According to this structure, since the outdoor heat exchanger 3 is disposed near the fan 4 in an upper section of the outdoor unit 10 in which the air suction efficiency of the fan 4 is high, the wind easily flows through the outdoor heat exchanger 3 at a high wind speed. Since the wind speed is high, the heat exchange efficiency can be increased and the performance of the outdoor heat exchanger 3 can be improved.

According to Embodiment 1, the outdoor unit 10 of the air-conditioning apparatus 100 is a top-flow outdoor unit in which the fan 4 that blows air upward is disposed above the heat exchange bodies 20. The heat exchange bodies 20 are disposed near the fan 4 in the upper section of the outdoor unit 10 of the air-conditioning apparatus 100.

According to this structure, a maintenance space for components, such as the compressor 1, disposed in a lower section of the housing 9 is provided in the lower section of the housing 9, so that the maintenance efficiency of the outdoor unit 10 of the air-conditioning apparatus 100 can be increased.

According to Embodiment 1, the compressor 1 is disposed in the housing 9 of the outdoor unit 10 of the air-conditioning apparatus 100. The bottom end of the outdoor heat exchanger 3 is positioned above the top end of the compressor 1.

According to this structure, maintenance, such as replacement, of the compressor 1 can be easily performed without changing the state of the outdoor heat exchanger 3. Thus, the maintenance efficiency can be increased.

According to Embodiment 1, the air-conditioning apparatus 100 includes the above-described outdoor unit 10 of the air-conditioning apparatus 100.

According to the air-conditioning apparatus 100 including the outdoor unit 10 of the air-conditioning apparatus 100 having the above-described structure, the lower portion of the outdoor heat exchanger 3 is preferentially defrosted and water discharge is facilitated so that the defrosting performance can be improved, and differences in the amount of heat exchange between the flat tubes 21 are reduced so that the heat exchange performance can be improved.

Embodiment 2

According to Embodiment 2, an outdoor heat exchanger 3 disposed to surround a fan 4 are divided into a plurality of portions. Portions of the outdoor heat exchanger 3 that are adjacent to each other are connected to each other by bent portions 30 and 31. In Embodiment 2, items that are not particularly described are similar to those in Embodiment 1, and description thereof is thus omitted.

<Structure of Outdoor Heat Exchanger 3>

Figure 6:
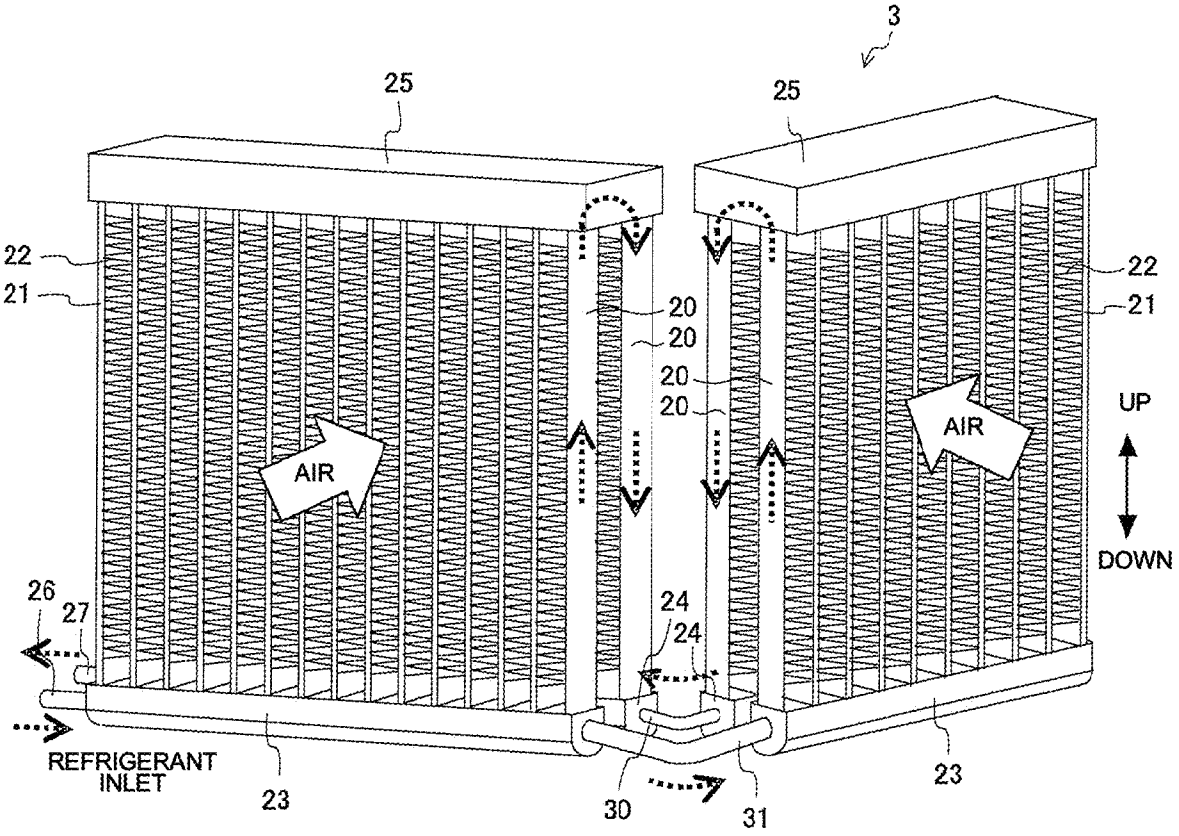
FIG. 6 is an enlarged perspective view of part of a heat exchanger according to Embodiment 2 of the present disclosure.

FIG. 6 is an enlarged perspective view of part of the outdoor heat exchanger 3 according to Embodiment 2 of the present disclosure. The overall body of the outdoor heat exchanger 3 illustrated in FIG. 6 includes a plurality of side portions that surround the fan 4, which is disposed above the outdoor heat exchanger 3 and from which wind is blown upward.

As illustrated in FIG. 6, the first header 23 and the refrigerant distributor 24 have bent portions 30 and 31 at intermediate positions thereof in a horizontal direction. The bent portions 30 and 31 are composed of bent pipes. Among the side portions of the outdoor heat exchanger 3 that surround the fan 4, two adjacent side portions of the outdoor heat exchanger 3 include portions of the first header 23 and the refrigerant distributor 24 that are connected by the bent portions 30 and 31.

The outer diameter of the bent portion 30 of the refrigerant distributor 24 is less than the outer diameter of the bent portion 31 of the first header 23. In other words, the outer diameter of the bent portion 30 of the first header 23 is greater than the outer diameter of the bent portion 31 of the refrigerant distributor 24.

The bent portion 30 of the refrigerant distributor 24 is formed by bending the inner pipe 24*a* of the double-pipe structure. In other words, the inner pipe 24*a* of the bent portion 30 of the refrigerant distributor 24 is a bent pipe.

Figure 7:
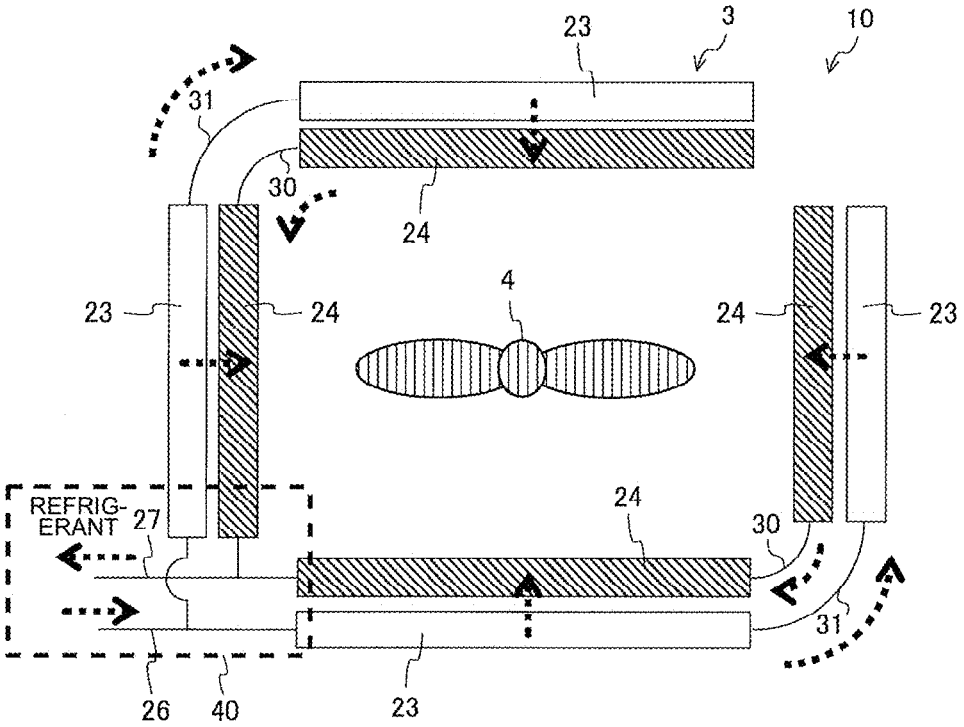
FIG. 7 is a refrigerant circuit diagram of an outdoor unit of an air-conditioning apparatus according to Embodiment 2 of the present disclosure.

FIG. 7 is a refrigerant circuit diagram of an outdoor unit 10 of an air-conditioning apparatus 100 according to Embodiment 2 of the present disclosure. As illustrated in FIG. 7, the outdoor heat exchanger 3 is divided into, for example, four side portions arranged so as to surround the fan 4. The outdoor heat exchanger 3 is structured such that portions of the first header 23 and the refrigerant distributor 24 included in two adjacent side portions thereof are connected by the bent portions 30 and 31 to form an L-shape. FIG. 7 shows the structure in which an L-shape is formed by the connection. However, the shape formed by the connection provided by the bent portions 30 and 31 is not limited to an L-shape.

The outdoor unit 10 of the air-conditioning apparatus 100 includes refrigerant pipes 26 and 27 that serve as refrigerant inlet-outlet pipes through which refrigerant flows into the outdoor heat exchanger 3 or flows out of the outdoor heat exchanger 3. Each of the refrigerant pipes 26 and 27 is connected to the first header 23 or the refrigerant distributor 24. The refrigerant pipes 26 and 27 are collectively disposed at one corner section 40 of the side portions that surround the downward projection region of the fan 4. In other words, the refrigerant pipes 26 and 27 are collectively disposed at the corner section 40 at one of the corners of the outdoor heat exchanger 3 including the four side portions.

<Operation of Embodiment 2>

As illustrated in FIG. 6, the outdoor unit 10 is structured such that two adjacent side portions of the outdoor heat exchanger 3 are connected to each other by the bent portions 30 and 31. The refrigerant pipes 26 and 27 through which the refrigerant flows into or out of the outdoor heat exchanger 3 are collectively disposed at the corner section 40 at one of the corners of the outdoor heat exchanger 3 including the four side portions. Accordingly, the installation space of the refrigerant pipes 26 and 27 required to cause the refrigerant to flow into the side portions of the outdoor heat exchanger 3 can be reduced, and the number of components can also be reduced. The bent portion 30 of the refrigerant distributor 24 may be formed by bending only the inner pipe 24*a* of the double-pipe structure. In this case, the bent portion 30 does not require any other component of a bent pipe, and the number of components can be further reduced.

The bent portion 31 of the first header 23, which is disposed outside the fan 4 at the center, has an outer diameter greater than that of the bent portion 30 of the refrigerant distributor 24, so that two adjacent side portions of the outdoor heat exchanger 3 can be connected at a smaller curvature. Therefore, the mounting efficiency of the outdoor heat exchanger 3 is increased. The mounting area of the outdoor heat exchanger 3 can be increased, whereby the operation efficiency of the air-conditioning apparatus 100 is increased.

<Effects of Embodiment 2>

According to Embodiment 2, the first header 23 and the refrigerant distributor 24 include the bent portions 30 and 31 at intermediate positions thereof in a horizontal direction. The outer diameter of the bent portion 30 of the refrigerant distributor 24 is less than the outer diameter of the bent portion 31 of the first header 23.

According to this structure, the heat exchange bodies 20 at two adjacent side portions can be connected to each other by the bent portions 30 and 31 such that the curvature decreases toward the center of the housing 9. Therefore, the mounting efficiency of the outdoor heat exchanger 3 can be increased. Thus, the mounting area of the outdoor heat exchanger 3 can be increased, and the operation efficiency of the air-conditioning apparatus 100 can be increased.

According to Embodiment 2, the bent portion 30 of the refrigerant distributor 24 is formed by bending the inner pipe 24*a* of the double-pipe structure.

According to this structure, the bent portion 30 does not require any other component, and the number of components can be reduced.

According to Embodiment 2, the outdoor unit 10 of the air-conditioning apparatus 100 includes the refrigerant pipes 26 and 27 that serve as refrigerant inlet-outlet pipes through which the refrigerant flows into the outdoor heat exchanger 3 or flows out of the outdoor heat exchanger 3. The refrigerant pipes 26 and 27 are disposed together at one corner section 40 of the side portions that surround the downward projection region of the fan 4.

According to this structure, the installation space of the refrigerant pipes 26 and 27 required to cause the refrigerant to flow into the heat exchange bodies 20 at the side portions can be reduced, and the number of components can also be reduced.

Embodiment 3

According to Embodiment 3, an outdoor heat exchanger 3 is divided into a main heat exchange section 61 and an auxiliary heat exchange section 62. In Embodiment 3, items that are not particularly described are similar to those in Embodiments 1 and 2, and description thereof is thus omitted.

<Structure of Outdoor Heat Exchanger 3>

Figure 8:
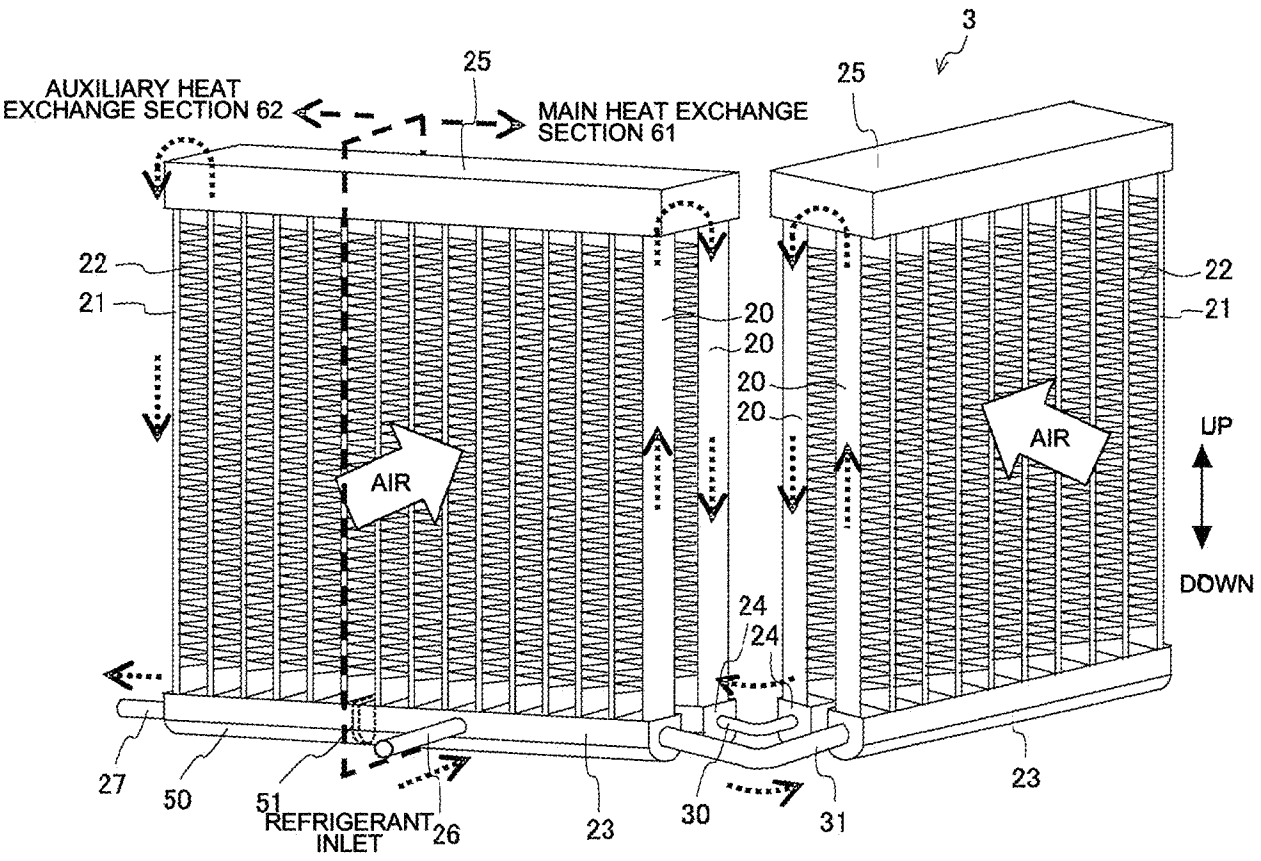
FIG. 8 is an enlarged perspective view of part of a heat exchanger according to Embodiment 3 of the present disclosure.

FIG. 8 is an enlarged perspective view of part of the outdoor heat exchanger 3 according to Embodiment 3 of the present disclosure. As illustrated in FIG. 8, the outdoor heat exchanger 3 includes the main heat exchange section 61 and the auxiliary heat exchange section 62. The main heat exchange section 61 and the auxiliary heat exchange section 62 adjoin each other on one side portion among the four side portions of the outdoor heat exchanger 3. Another side portion of the outdoor heat exchanger 3 is constituted by another portion of the main heat exchange section 61 that is connected to the main heat exchange section 61 on the one side portion by the bent portions 30 and 31. The four side portions of the outdoor heat exchanger 3 are two pairs of side portions, each pair including one side portion having the main heat exchange section 61 and the auxiliary heat exchange section 62 and another side portion formed by another portion of the main heat exchange section 61 connected to the main heat exchange section 61 on the one side portion by the bent portions 30 and 31.

<Main Heat Exchange Section 61>

The main heat exchange section 61 includes a plurality of heat exchange bodies 20 arranged in the direction of air flow and a first header 23. More specifically, the main heat exchange section 61 includes the first header 23 and a refrigerant distributor 24. In a defrosting operation performed in a low-temperature environment in which frost is formed and melted, hot gas refrigerant flows into the first header 23 at a position below the heat exchange body 20 at the most upwind position. The refrigerant distributor 24 is disposed below the heat exchange body 20 at the most downwind position. The refrigerant pipe 26 is connected to the first header 23.

<Auxiliary Heat Exchange Section 62>

The auxiliary heat exchange section 62 includes a plurality of heat exchange bodies 20 arranged in the direction of air flow and a second header 50. The number of flat tubes 21 included in the heat exchange bodies 20 of the auxiliary heat exchange section 62 is smaller than the number of flat tubes 21 included in the heat exchange bodies 20 of the main heat exchange section 61. The second header 50 is referred to also as a liquid header. Thus, the auxiliary heat exchange section 62 includes the second header 50 and the refrigerant distributor 24. The number of flat tubes 21 inserted into the second header 50 is smaller than the number of flat tubes 21 inserted into the first header 23. The second header 50 is disposed next to the first header 23 and below the heat exchange body 20 at the most upwind position. The refrigerant distributor 24 is disposed below the heat exchange body 20 at the most downwind position. The main heat exchange section 61 and the auxiliary heat exchange section 62 communicate with each other through the refrigerant distributor 24. The refrigerant pipe 27 is connected to the second header 50.

The auxiliary heat exchange section 62 has a refrigerant flow passage along which, when the outdoor heat exchanger 3 functions as a condenser, the refrigerant flows into one of the heat exchange bodies 20 at the most downwind position and flows out of one of the heat exchange bodies 20 at the most upwind position so that the refrigerant and air flow in opposite directions.

<Overall Structure of Outdoor Heat Exchanger 3>

The main heat exchange section 61 and the auxiliary heat exchange section 62 are connected to each other by the refrigerant distributor 24 disposed at the downwind position. The outdoor heat exchanger 3 includes a plurality of side portions that surround the fan 4, which is disposed above the outdoor heat exchanger 3 and from which wind is blown upward. The main heat exchange section 61 includes the bent portions 30 and 31 at intermediate positions of the first header 23 and the refrigerant distributor 24. Thus, the main heat exchange section 61 extends along two side portions that are adjacent to each other.

The first header 23 and the second header 50 are formed as an integral header structure and are separated from each other by a partition plate 51 provided in the integral header structure. The first header 23 and the second header 50 may instead be formed as different header structures that are connected to each other.

Figure 9:
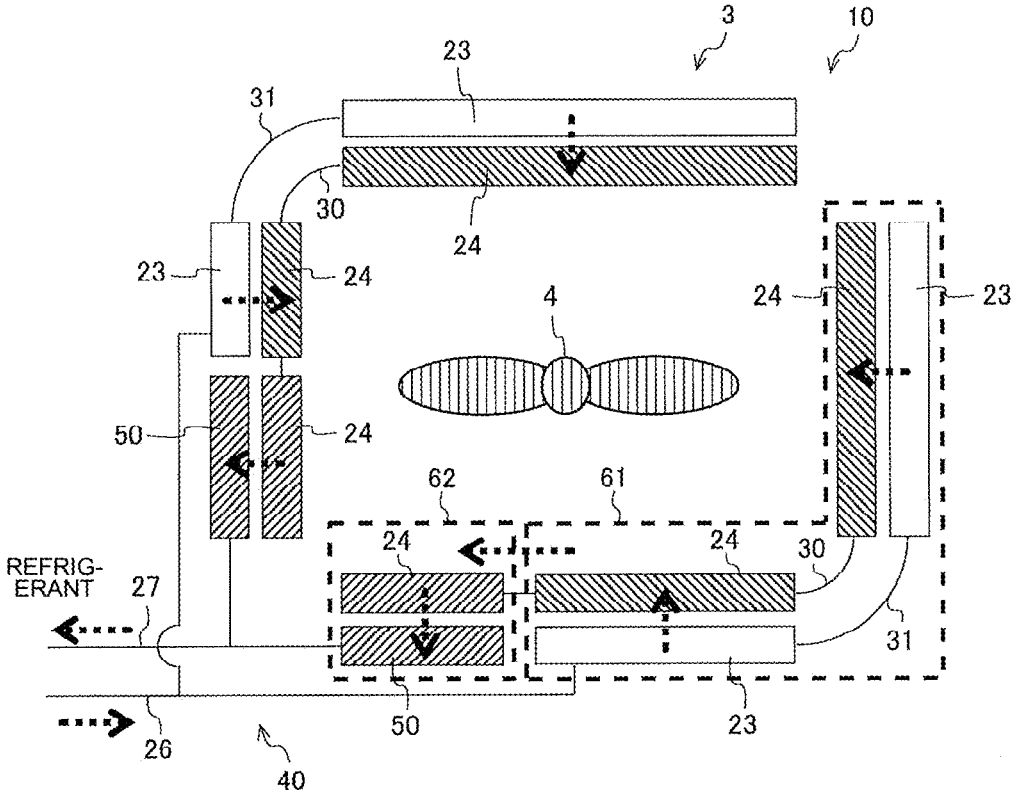
FIG. 9 is a refrigerant circuit diagram of an outdoor unit of an air-conditioning apparatus according to Embodiment 3 of the present disclosure.

FIG. 9 is a refrigerant circuit diagram of an outdoor unit 10 of an air-conditioning apparatus 100 according to Embodiment 3 of the present disclosure. As illustrated in FIG. 9, the outdoor heat exchanger 3 includes two heat exchangers which each include the main heat exchange section 61 including the bent portions 30 and 31 and formed in an L-shape and the auxiliary heat exchange section 62. Thus, the outdoor heat exchanger 3 is divided into, for example, four side portions arranged to surround the fan 4. The two heat exchangers of the outdoor heat exchanger 3 are arranged such that the main heat exchange sections 61 and the auxiliary heat exchange sections 62 thereof are symmetric about a diagonal line passing through one corner section 40 at one of the corners between the four side portions. In such a case, the refrigerant pipes 26 and 27 through which the refrigerant flows into or out of the outdoor heat exchanger 3 are collectively disposed at the corner section 40 at one of the corners, and the number of components can be reduced.

<Operation of Outdoor Heat Exchanger 3>

<Heating Operation>

In a heating operation, the outdoor heat exchanger 3 functions as an evaporator. Two-phase gas-liquid refrigerant that flows into the outdoor heat exchanger 3 from the refrigerant circuit enters the second header 50 first and flows through the auxiliary heat exchange section 62, thereby exchanging heat with air carried by the wind generated by the fan 4 so that the quality thereof is increased. After that, the refrigerant that has flowed through the auxiliary heat exchange section 62 flows into the refrigerant distributor 24 and enters the main heat exchange section 61. The refrigerant that has entered the main heat exchange section 61 flows through the inner pipe 24*a* inserted into the outer pipe 24*b* of the refrigerant distributor 24, passes through the refrigerant holes 24*c*, and is stirred in the space defined between the inner pipe 24*a* and the outer pipe 24*b*. Thus, the refrigerant flows in a state close to that of homogeneous flow. The refrigerant that flows in a homogenized state is evenly distributed between the flat tubes 21, exchanges heat with air on the wind generated by the fan 4, and is evaporated. After the heat exchange, the refrigerant flows out of the outdoor heat exchanger 3 through the first header 23. The refrigerant that flows through the main heat exchange section 61 flows through the flat tubes 21 of the heat exchange body 20 at the downwind position first, and then flows through the flat tubes 21 of the heat exchange body 20 at the upwind position. Thus, air and the refrigerant flow in opposite directions.

<Defrosting Operation>

When the heating operation is performed in a low-temperature environment in which the surface temperatures of the flat tubes 21 and the fins 22 are less than or equal to 0 degrees C., frost accumulates on the outdoor heat exchanger 3. Therefore, when the amount of frost on the outdoor heat exchanger 3 reaches or exceeds a certain amount, a defrosting operation is performed to melt the frost on the surface of the outdoor heat exchanger 3.

In the defrosting operation, the fan 4 is stopped and the refrigerant circuit is switched to the cooling operation, for example, so that hot gas refrigerant at a high temperature flows into the outdoor heat exchanger 3. Thus, the frost on the flat tubes 21 and the fins 22 is melted. In the defrosting operation, the hot gas refrigerant at a high temperature flows through the outdoor heat exchanger 3 in a direction opposite to the direction in which the refrigerant flows when the outdoor heat exchanger 3 functions an evaporator as described above. More specifically, the hot gas refrigerant flows through the first header 23 disposed below the heat exchange body 20 at the most upwind position in the main heat exchange section 61 and enters each of the flat tubes 21. The high-temperature refrigerant that has entered the flat tubes 21 melts the frost on the flat tubes 21 and the fins 22 into water from the bottom. The water generated when the frost is melted is discharged toward the bottom of the outdoor heat exchanger 3 along the flat tubes 21 and the fins 22. When the accumulated frost is melted, the defrosting operation is ended and the heating operation is restarted.

<Cooling Operation>

In a cooling operation, in which the outdoor heat exchanger 3 functions as a condenser, the refrigerant flows in a direction opposite to the direction in which the refrigerant flows when the outdoor heat exchanger 3 functions as an evaporator as described above. When the outdoor heat exchanger 3 functions as a condenser, the refrigerant that enters the outdoor heat exchanger 3 from the refrigerant circuit flows into the first header 23 in a superheated gas state at a high temperature, and exchanges heat with air on the wind generated by the fan 4 in the main heat exchange section 61. Accordingly, the gas refrigerant changes into two-phase gas-liquid refrigerant, which flows through the refrigerant distributor 24 and enters the auxiliary heat exchange section 62. The refrigerant that has entered the auxiliary heat exchange section 62 exchanges heat with air on the wind generated by the fan 4. Thus, the two-phase gas-liquid refrigerant is condensed into liquid refrigerant, which flows out of the outdoor heat exchanger 3 through the second header 50. The refrigerant that flows through the auxiliary heat exchange section 62 flows through the flat tubes 21 of the heat exchange body 20 at the downwind position first, and then flows through the flat tubes 21 of the heat exchange body 20 at the upwind position. Thus, air and the refrigerant flow in opposite directions.

<Operation of Embodiment 3>

Figure 10:
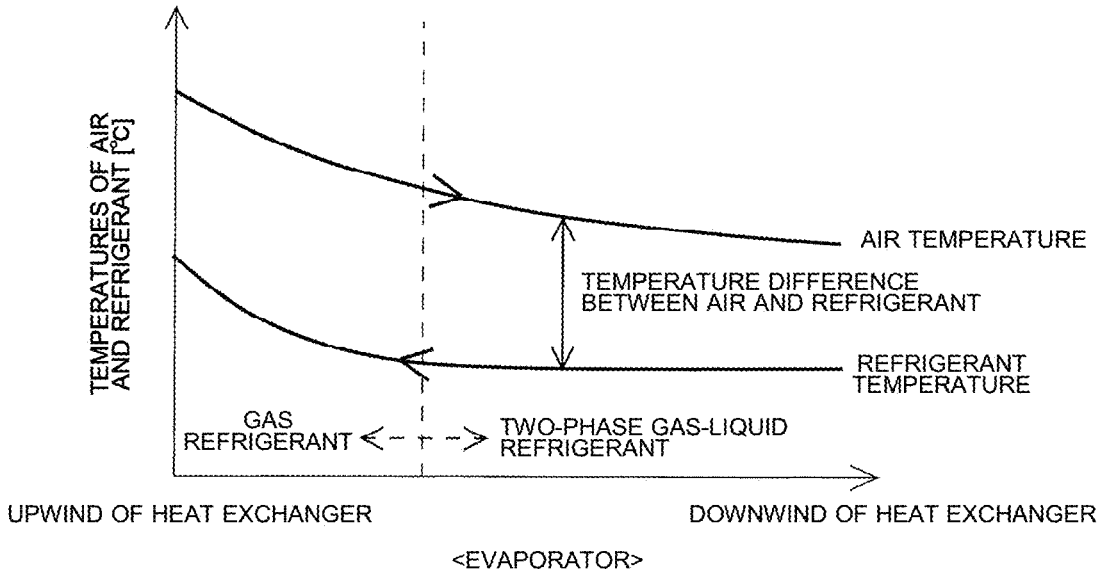
FIG. 10 is a graph showing the temperature variations of air and refrigerant when the heat exchanger according to Embodiment 3 of the present disclosure functions as an evaporator.
Figure 11:
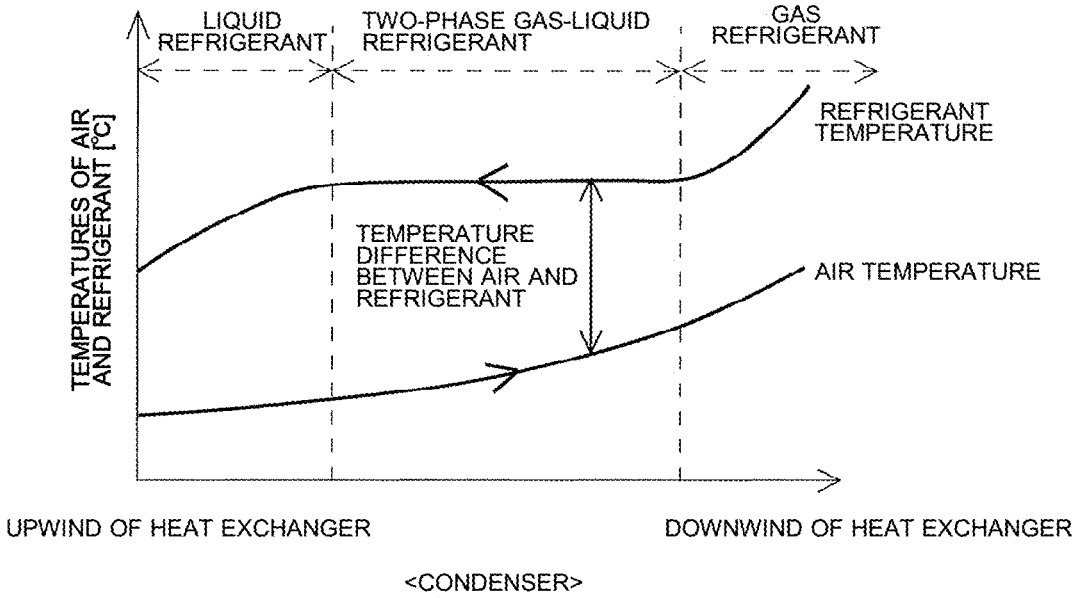
FIG. 11 is a graph showing the temperature variations of air and refrigerant when the heat exchanger according to Embodiment 3 of the present disclosure functions as a condenser.

FIG. 10 is a graph showing the temperature variations of air and refrigerant when the outdoor heat exchanger 3 according to Embodiment 3 of the present disclosure functions as an evaporator, FIG. 11 is a graph showing the temperature variations of air and refrigerant when the outdoor heat exchanger 3 according to Embodiment 3 of the present disclosure functions as a condenser.

The outdoor heat exchanger 3 includes the main heat exchange section 61 and the auxiliary heat exchange section 62. In the main heat exchange section 61, refrigerant that flows toward the first header 23, which serves as a heat exchanger outlet for an evaporator, and air flow in opposite directions. In the auxiliary heat exchange section 62, refrigerant that flows toward the second header 50, which serves as a heat exchanger outlet for a condenser, and air flow in opposite directions. The refrigerant that flows through the outlet for an evaporator is gas refrigerant, and the refrigerant that flows through the outlet for a condenser is liquid refrigerant. In each case, the refrigerant is in a single phase. Accordingly, the temperature of the refrigerant varies during the heat exchange. FIGS. 10 and 11 show the temperature variations of the air and refrigerant that flow through the outdoor heat exchanger 3 when the outdoor heat exchanger 3 serves as an evaporator and a condenser, respectively. As illustrated in FIGS. 10 and 11, the air temperature and the refrigerant temperature constantly have a difference therebetween during the heat exchange, so that the heat exchange performance can be improved. In Embodiment 3, the auxiliary heat exchange section 62 is provided in which the refrigerant and air flow in opposite directions when the outdoor heat exchanger 3 functions as a condenser. Accordingly, the outdoor heat exchanger 3 includes a portion in which air and the refrigerant flow in opposite directions both when the outdoor heat exchanger 3 functions as an evaporator and when the outdoor heat exchanger 3 functions as a condenser, so that the heat exchange performance can be improved in both the heating operation and the cooling operation.

<Effects of Embodiment 3>

According to Embodiment 3, the outdoor unit 10 of the air-conditioning apparatus 100 includes the main heat exchange section 61 including the heat exchange bodies 20 arranged in the direction of air flow and the first header 23. The outdoor unit 10 of the air-conditioning apparatus 100 also includes the auxiliary heat exchange section 62 including the heat exchange bodies 20 arranged in the direction of air flow and the second header 50. The number of flat tubes 21 included in the heat exchange bodies 20 of the auxiliary heat exchange section 62 is smaller than the number of flat tubes 21 included in the heat exchange bodies 20 of the main heat exchange section 61. The auxiliary heat exchange section 62 has a refrigerant flow passage along which, when the outdoor heat exchanger 3 functions as a condenser, the refrigerant flows into one of the heat exchange bodies 20 at the most downwind position and flows out of one of the heat exchange bodies 20 at the most upwind position so that the refrigerant and air flow in opposite directions.

According to this structure, when the main heat exchange section 61 functions as an evaporator, a refrigerant flow passage is formed along which the refrigerant flows into one of the heat exchange bodies 20 at the most downwind position and flows out of one of the heat exchange bodies 20 at the most upwind position so that the refrigerant and air flow in opposite directions. In addition, when the auxiliary heat exchange section 62 functions as a condenser, a refrigerant flow passage is formed along which the refrigerant flows into one of the heat exchange bodies 20 at the most downwind position and flows out of one of the heat exchange bodies 20 at the most upwind position so that the refrigerant and air flow in opposite directions. Therefore, the air temperature and the refrigerant temperature constantly have a difference therebetween during the heat exchange, so that the heat exchange performance can be improved. Thus, the outdoor heat exchanger 3 includes a portion in which air and the refrigerant flow in opposite directions both when the outdoor heat exchanger 3 functions as an evaporator and when the outdoor heat exchanger 3 functions as a condenser, so that the heat exchange performance can be improved in both the heating operation and the cooling operation.

According to Embodiment 3, the main heat exchange section 61 and the auxiliary heat exchange section 62 communicate with each other through the refrigerant distributor 24.

According to this structure, the main heat exchange section 61 and the auxiliary heat exchange section 62 can be connected to each other without using a component other than the refrigerant distributor 24. Therefore, the number of components can be reduced.

Embodiment 4

According to Embodiment 4, an outdoor heat exchanger 3 is divided into a main heat exchange section 61 and an auxiliary heat exchange section 62. In this outdoor heat exchanger 3, the auxiliary heat exchange section 62 is disposed together at one of a plurality of side portions that surround a fan 4. In Embodiment 4, items that are not particularly described are similar to those in Embodiments 1 to 3, and description thereof is thus omitted.

<Structure of Outdoor Heat Exchanger 3>

Figure 12:
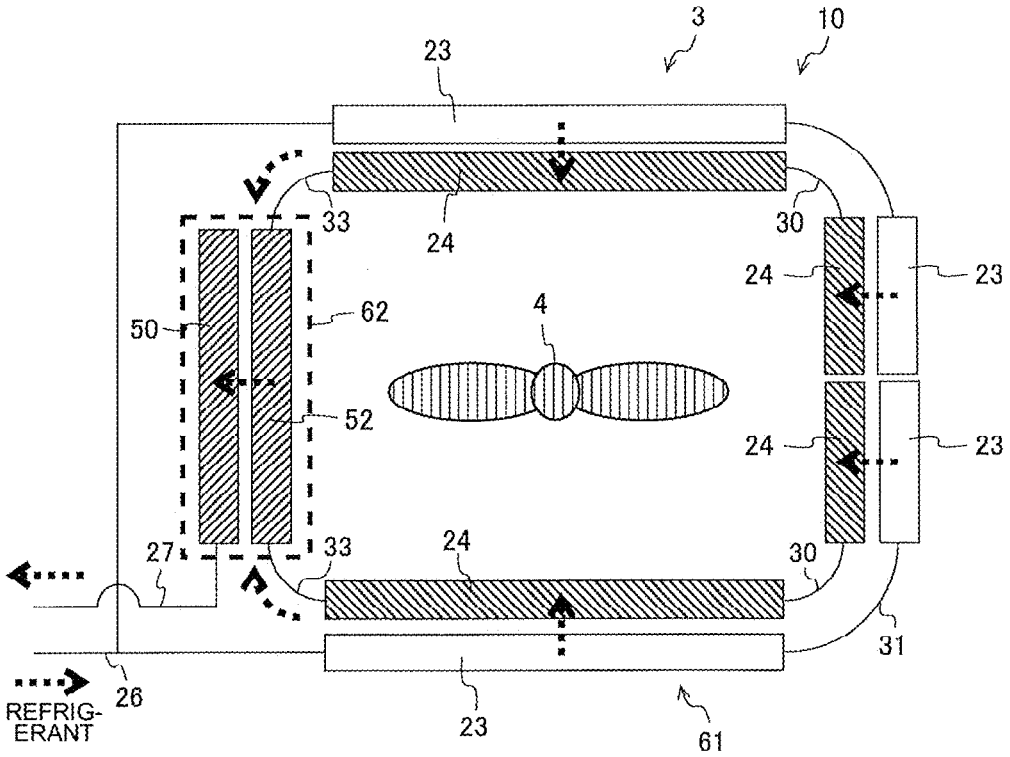
FIG. 12 is a refrigerant circuit diagram of an outdoor unit of an air-conditioning apparatus according to Embodiment 4 of the present disclosure.

FIG. 12 is a refrigerant circuit diagram of an outdoor unit 10 of an air-conditioning apparatus 100 according to Embodiment 4 of the present disclosure. As illustrated in FIG. 12, the auxiliary heat exchange section 62 is disposed at one of the side portions of the outdoor heat exchanger 3. The main heat exchange section 61 is disposed at the other side portions of the outdoor heat exchanger 3 at which the auxiliary heat exchange section 62 is not disposed. The main heat exchange section 61 and the auxiliary heat exchange section 62 are provided as separate sections.

The main heat exchange section 61 includes a first header 23 and a refrigerant distributor 24. In a defrosting operation performed in a low-temperature environment in which frost is formed and melted, hot gas flows into the first header 23 at a position below the heat exchange body 20 at the most upwind position. The refrigerant distributor 24 is disposed below the heat exchange body 20 at the most downwind position.

The auxiliary heat exchange section 62 includes a second header 50 in which the flat tubes 21 are inserted and that is disposed below the heat exchange body 20 at the most upwind position and a refrigerant distributor 52 disposed below the heat exchange body 20 at the most downwind position.

The refrigerant distributor 52 of the auxiliary heat exchange section 62 may be a component separate from the refrigerant distributor 24 of the main heat exchange section 61. The refrigerant distributor 52 of the auxiliary heat exchange section 62 may instead be a component integrated with the refrigerant distributor 24 of the main heat exchange section 61 with bent portions 33 provided therebetween.

The outdoor heat exchanger 3 is structured such that the auxiliary heat exchange section 62 is collectively disposed at one of the four side portions of the outdoor heat exchanger 3 that are arranged so as to surround the fan 4. In addition, the outdoor heat exchanger 3 is structured such that portions of the main heat exchange section 61 that are connected to each other by the bent portions 30 and 31 to form a U-shape are disposed at the other three sides.

<Operation of Embodiment 4>

The auxiliary heat exchange section 62 and the main heat exchange section 61 cause the refrigerant to flow through the flat tubes 21 thereof at different temperatures when serving as condensers. Superheated gas refrigerant at a high temperature enters the first header 23 of the main heat exchange section 61. The refrigerant that has entered exchanges heat with air on the wind generated by the fan 4 in the main heat exchange section 61, and thereby changes into two-phase gas-liquid refrigerant. The two-phase gas-liquid refrigerant exchanges heat with air on the wind generated by the fan 4 in the auxiliary heat exchange section 62, and is thereby condensed into low-temperature liquid refrigerant. The outdoor heat exchanger 3 is structured such that the flat tubes 21 of the auxiliary heat exchange section 62 and the flat tubes 21 of the main heat exchange section 61 are not connected to each other by the fins 22, the first header 23, or the second header 50. Therefore, heat exchange between refrigerants at different temperatures can be prevented, so that the performance of the outdoor heat exchanger 3 can be improved.

<Effects of Embodiment 4>

According to Embodiment 4, the auxiliary heat exchange section 62 is disposed at one of the side portions of the outdoor heat exchanger 3. The main heat exchange section 61 is disposed at the other side portions of the outdoor heat exchanger 3 at which the auxiliary heat exchange section 62 is not disposed. The main heat exchange section 61 and the auxiliary heat exchange section 62 are provided as separate sections.

According to this structure, the main heat exchange section 61 and the auxiliary heat exchange section 62 are not connected to each other by one component. Therefore, heat exchange between refrigerants at different temperatures can be prevented, so that the performance of the outdoor heat exchanger 3 can be improved.

Embodiments 1 to 4 of the present disclosure may be applied in combination, or may be applied to other parts.

REFERENCE SIGNS LIST

1 compressor 2 four-way valve 3 outdoor heat exchanger 4 fan 5 expansion valve 6 indoor heat exchanger 7 fan 8 accumulator 9 housing 10 outdoor unit 11, 12, 13 indoor unit 20 heat exchange body 21 flat tube 22 fin 23 first header 24 refrigerant distributor 24*a* inner pipe 24*b* outer pipe 24*c* refrigerant hole 25 turnaround header 26, 27 refrigerant pipe 30, 31, 33 bent portion 40 corner section 50 second header 51 partition plate 52 refrigerant distributor 61 main heat exchange section 62 auxiliary heat exchange section 100 air-conditioning apparatus

The invention claimed is:

1. An outdoor unit of an air-conditioning apparatus, comprising:

a plurality of heat exchange bodies each including a plurality of flat tubes that extend in a vertical direction and that are arranged in a horizontal direction with gaps therebetween, wherein the plurality of heat exchange bodies are arranged in a direction of air flow to form a heat exchanger, wherein a first header, into which hot gas refrigerant flows from a refrigerant circuit, is provided below one of the plurality of heat exchange bodies that is at a most upwind position, and wherein a refrigerant distributor having a double-pipe structure is provided below one of the plurality of heat exchange bodies that is at a most downwind position, the double-pipe structure including an inner pipe having a plurality of refrigerant holes through which refrigerant flows and that are arranged with gaps therebetween, and an outer pipe into which the inner pipe is inserted.

2. The outdoor unit of an air-conditioning apparatus of claim 1, wherein the heat exchanger has a refrigerant flow passage along which, when the heat exchanger functions as an evaporator, the refrigerant flows into the one of the plurality of the heat exchange bodies that is at the most downwind position through the refrigerant distributor and flows out of the one of the plurality of the heat exchange bodies that is at the most upwind position so that the refrigerant and air flow in opposite directions.

3. The outdoor unit of an air-conditioning apparatus of claim 2, wherein each of the first header and the refrigerant distributor includes a bent portion at an intermediate position thereof in the horizontal direction, and wherein an outer diameter of the bent portion of the refrigerant distributor is less than an outer diameter of the bent portion of the first header.

4. The outdoor unit of an air-conditioning apparatus of claim 2, wherein the bent portion of the refrigerant distributor is formed by bending the inner pipe of the double-pipe structure.

5. The outdoor unit of an air-conditioning apparatus of claim 1, wherein the outdoor unit includes a main heat exchange section including a first plurality of heat exchange bodies arranged in the direction of air flow and the first header, and an auxiliary heat exchange section including a second plurality of heat exchange bodies arranged in the direction of air flow and a second header, the plurality of flat tubes included in the second plurality of heat exchange bodies of the auxiliary heat exchange section being less in number than the plurality of flat tubes included in the first plurality of heat exchange bodies of the main heat exchange section, and wherein the auxiliary heat exchange section has a refrigerant flow passage along which, when the heat exchanger functions as a condenser, the refrigerant flows into one of the second plurality of the heat exchange bodies at a most downwind position and flows out of one of the second plurality of the heat exchange bodies at a most upwind position so that the refrigerant and air flow in opposite directions.

6. The outdoor unit of an air-conditioning apparatus of claim 5, wherein the main heat exchange section and the auxiliary heat exchange section communicate with each other through the refrigerant distributor.

7. The outdoor unit of an air-conditioning apparatus of claim 1, further comprising:

a fan that blows air upward, wherein the fan is disposed above the heat exchanger, and wherein the heat exchanger includes a plurality of side portions that surround a downward projection region of the fan.

8. The outdoor unit of an air-conditioning apparatus of claim 7, wherein the heat exchanger is disposed in an upper section of a housing, the upper section being adjacent to the fan.

9. The outdoor unit of an air-conditioning apparatus of claim 7, wherein the auxiliary heat exchange section is disposed at one of the plurality of side portions of the heat exchanger, wherein the main heat exchange section is disposed at another one of the plurality of side portions of the heat exchanger at which the auxiliary heat exchange section is not disposed, and wherein the main heat exchange section and the auxiliary heat exchange section are formed as separate sections.

10. The outdoor unit of an air-conditioning apparatus of claim 1, wherein the outdoor unit of an air-conditioning apparatus is a top-flow outdoor unit in which a fan that blows air upward is disposed above the plurality of the heat exchange bodies, and wherein the plurality of the heat exchange bodies are disposed near the fan in an upper section of the outdoor unit of an air-conditioning apparatus.

11. The outdoor unit of an air-conditioning apparatus of claim 10, wherein a compressor is disposed in a housing of the outdoor unit of an air-conditioning apparatus, and wherein a bottom end of the heat exchanger is positioned above a top end of the compressor.

12. An air-conditioning system comprising:

the outdoor unit of the air-conditioning apparatus of claim 1; and a plurality of indoor units.

13. An outdoor unit of an air-conditioning apparatus, comprising:

a plurality of heat exchange bodies each including a plurality of flat tubes that extend in a vertical direction and that are arranged in a horizontal direction with gaps therebetween, wherein the plurality of the heat exchange bodies are arranged in a direction of air flow to form a heat exchanger, wherein a first header, into which hot gas refrigerant flows from a refrigerant circuit, is provided below one of the plurality of the heat exchange bodies that is at a most upwind position and further comprising:

a fan that blows air upward, wherein the fan is disposed above the heat exchanger, and wherein the heat exchanger includes a plurality of side portions that surround a downward projection region of the fan, refrigerant inlet-outlet pipes through which the refrigerant flows into the heat exchanger or flows out of the heat exchanger, wherein the refrigerant inlet-outlet pipes are disposed at one corner section of the plurality of side portions that surround the downward projection region of the fan.

14. An outdoor unit of an air-conditioning apparatus, comprising:

a plurality of heat exchange bodies each including a plurality of flat tubes that extend in a vertical direction and that are arranged in a horizontal direction with gaps therebetween, wherein the plurality of the heat exchange bodies are arranged in a direction of air flow to form a heat exchanger, wherein a first header, into which hot gas refrigerant flows from a refrigerant circuit, is provided below one of the plurality of the heat exchange bodies that is at a most upwind position, wherein the outdoor unit includes a main heat exchange section including a plurality of the heat exchange bodies arranged in the direction of air flow and the first header, and an auxiliary heat exchange section including a plurality of the heat exchange bodies arranged in the direction of air flow and a second header, the plurality of flat tubes included in the plurality of the heat exchange bodies of the auxiliary heat exchange section being less in number than the plurality of flat tubes included in the plurality of the heat exchange bodies of the main heat exchange section, and wherein the auxiliary heat exchange section has a refrigerant flow passage along which, when the heat exchanger functions as a condenser, the refrigerant flows into one of the plurality of the heat exchange bodies at a most downwind position and flows out of one of the plurality of the heat exchange bodies at a most upwind position so that the refrigerant and air flow in opposite directions.

15. The outdoor unit of an air-conditioning apparatus of claim 14, wherein a fan that blows air upward, wherein the fan is disposed above the heat exchanger, wherein the heat exchanger includes a plurality of side portions that surround a downward projection region of the fan, wherein the auxiliary heat exchange section is disposed at one of the plurality of side portions of the heat exchanger, wherein the main heat exchange section is disposed at another one of the plurality of side portions of the heat exchanger at which the auxiliary heat exchange section is not disposed, and wherein the main heat exchange section and the auxiliary heat exchange section are formed as separate sections.

* * * * *